US011772850B1

(12) United States Patent
Zamora et al.

(10) Patent No.: US 11,772,850 B1
(45) Date of Patent: Oct. 3, 2023

(54) CONTAINER CAP AND SEALING ASSEMBLY

(71) Applicant: Genicook Product LLC, Garland, TX (US)

(72) Inventors: Marc Salvador Zamora, Barcelona (ES); David de Sicart Prieto, Barcelona (ES)

( * ) Notice: Subject to any disclaimer, the term of this patent is extended or adjusted under 35 U.S.C. 154(b) by 0 days.

(21) Appl. No.: 17/691,022

(22) Filed: Mar. 9, 2022

(51) Int. Cl.
*B65D 41/02* (2006.01)
*B65D 51/24* (2006.01)

(52) U.S. Cl.
CPC ..... *B65D 41/023* (2013.01); *B65D 51/242* (2013.01)

(58) Field of Classification Search
CPC .... B65D 41/023; B65D 51/242; B65D 39/16; B65D 83/20
USPC ..... 215/272, 358, 359, 315, 295, 301
See application file for complete search history.

(56) References Cited

U.S. PATENT DOCUMENTS 4,268,360 A * 5/1981 Tsuzuki ..... C10B 29/06 220/233
9,221,585 B1 * 12/2015 Wang ..... B65D 41/02
10,301,078 B2 5/2019 Shao
2004/0067091 A1 * 4/2004 Tsutsumi ..... B65D 55/12 215/280
2008/0272085 A1 * 11/2008 Laporta ..... B65D 39/0064 215/358
2015/0108080 A1 * 4/2015 Grittmann ..... B65D 45/32 215/359
2018/0050846 A1 * 2/2018 Shao ..... B65D 39/16

* cited by examiner

*Primary Examiner* — Valentin Neacsu
*Assistant Examiner* — Eric C Baldrighi
(74) *Attorney, Agent, or Firm* — entelechy Ip; Johnfar Kerlee

(57) ABSTRACT

Disclosed are embodiments of containers, caps, sealing assemblies, and associated components. In one embodiments, a sealing assembly can include an expander actuator operatively coupled to an expander, which expander is operatively coupled to a seal. In a locking state, the expander actuator is configured to cause the expander to expand horizontally against the seal. The expansion of the seal against a shoulder and/or a neck of a container provides a locking, leak-proof seal. In an opening state, the expander is configured to provide an upward movement of the expander actuator, allowing the expander to return to its unexpanded form, which in turn causes the seal to return to its unexpanded form. When the seal is in its unexpanded form, the sealing assembly (along with an associated cap) can be pulled away from the container body.

20 Claims, 13 Drawing Sheets

CONTAINER CAP AND SEALING ASSEMBLY

FIELD

Embodiments of the invention relate generally to portable, dispensing containers. In particular, embodiments of the invention are directed to cap assemblies for bottles.

BACKGROUND

Portable containers, such as tumblers, mugs, and the like, are commonly used to, for example, dispense liquids when walking, driving, or otherwise traveling. Portable containers typically include a container body and a cap that is removably coupled to the container body.

Known containers often include threaded caps or solid rubber caps, which are inconvenient in daily use. The threaded cap, for example, requires a cumbersome rotation for opening and closing the container. In the solid rubber cap case there is often a need for auxiliary tools to open, and tends to require more time. A rubber cap that opens easily tends to provide poor sealing, has limited service life, and can fall into the container after long-term use. Thus, some known caps are difficult to open and close quickly, are inconvenient to use because of the difficulty of opening and closing, have limited service life due to incapability of repeated opening and closing, have poor sealing and leakage-proof performance due to poor closed sealing performance, and have poor operability due to requiring other tools for opening.

There is still a need in the relevant technology for caps that can be used to open and close containers in convenient and intuitive manner. Furthermore there continues to be a need in the relevant technology for caps that are durable and provide efficient sealing. Embodiments of the invention disclosed here satisfy these and other needs.

SUMMARY OF THE INVENTION

In one aspect, the invention is directed to a cap having a seal; an expander configured to expand horizontally against the seal; an expander actuator configured to operatively couple to the expander; and one or more opening buttons configured to operatively couple to the expander rod. The opening button can be configured to disengage from the expander actuator upon the application of a first external force to the opening button. The expander rod can be configured to produce a horizontal expansion of the expander upon the application of a second external force to the expander actuator. In some embodiments, the cap can further include an expander holder configured to receive and support the expander. In certain embodiments, the cap can further include an expander retainer configured to facilitate constraining a movement of the expander in a vertical direction. In one embodiment, the expander actuator includes a closing button operatively coupled to an expander rod. In some embodiments, the seal includes a seal base and an annular vertical seal wall, and the seal base and at least part of the seal wall are configured to expand horizontally upon a horizontal expansion of the expander against the seal wall. In some embodiments, the expander includes an annular expander wall that is operatively coupled to the expander actuator, the expander wall is configured to expand horizontally against the seal upon an engagement of the expander actuator with the expander, and the expander wall is configured to return to an unexpanded form upon a disengagement of the expander actuator from the expander. In certain embodiments, the expander can further include expander radial arms configured to engage with the expander actuator, the expander radial arms are configured to move horizontally towards the seal wall upon an engagement of the expander actuator with the expander, and the expander arms are configured to move horizontally away from the seal wall upon a disengagement of the expander actuator from the expander.

In yet another aspect, the invention concerns a cap having a plurality of opening buttons configured to move towards a central axis of a container upon the application of a first force to the plurality of opening buttons; an expander actuator configured to operatively couple to the plurality of opening buttons, wherein the expander actuator and the plurality of opening buttons are configured to produce a disengagement of the opening buttons from the expander actuator upon the application of the first force to the plurality of opening buttons; an expander configured to operatively couple to the expander actuator, wherein the expander is configured to expand horizontally upon an application of a second force to the expander actuator; and a seal configured to operatively couple to the expander, wherein the seal is configured to expand against a wall of the container upon an horizontal expansion of the expander against the seal. In one embodiment, the opening buttons are configured to move horizontally relative to a central axis of the container upon application of the first force to the plurality of opening buttons. In some embodiments, the expander actuator is configured to move parallel to, or along, a central axis of the container upon the application of the second force to the expander actuator. In certain embodiments, the expander actuator includes a closing button operatively coupled to an expander rod. In one embodiment, the expander rod is configured to transfer the second force to the expander. In some embodiments, the cap further includes an expander holder configured to receive and support the expander. In certain embodiments, the cap can further include an expander retainer configured to constrain a vertical movement, along the central axis of the container, of the expander.

Another aspect of the invention is directed to a sealing assembly having an expander actuator configured to move vertically along a main axis of a container; an expander configured to operatively couple to the expander actuator, wherein the expander is configured to expand horizontally upon an application of a first force to the expander actuator; and a seal configured to operatively couple to the expander, wherein the seal is configured to expand against a wall of the container upon an horizontal expansion of the expander against the seal. In one embodiment, the sealing assembly can further include at least one opening button configured to operatively couple to the expander actuator, wherein the expander actuator and the at least one opening button are configured to produce a disengagement of the at least one opening button from the expander actuator upon the application of a second force to the at least one opening button. In some embodiments, the sealing assembly can further include an expander holder configured to receive and support the expander. In certain embodiments, the sealing assembly can further include an expander retainer configured to constrain a vertical movement of the expander. In one embodiment, the expander is configured to cause a vertical upward movement of the expander actuator upon the disengagement of the at least one opening button from the expander actuator.

Both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

DETAILED DESCRIPTION

Figure 1:
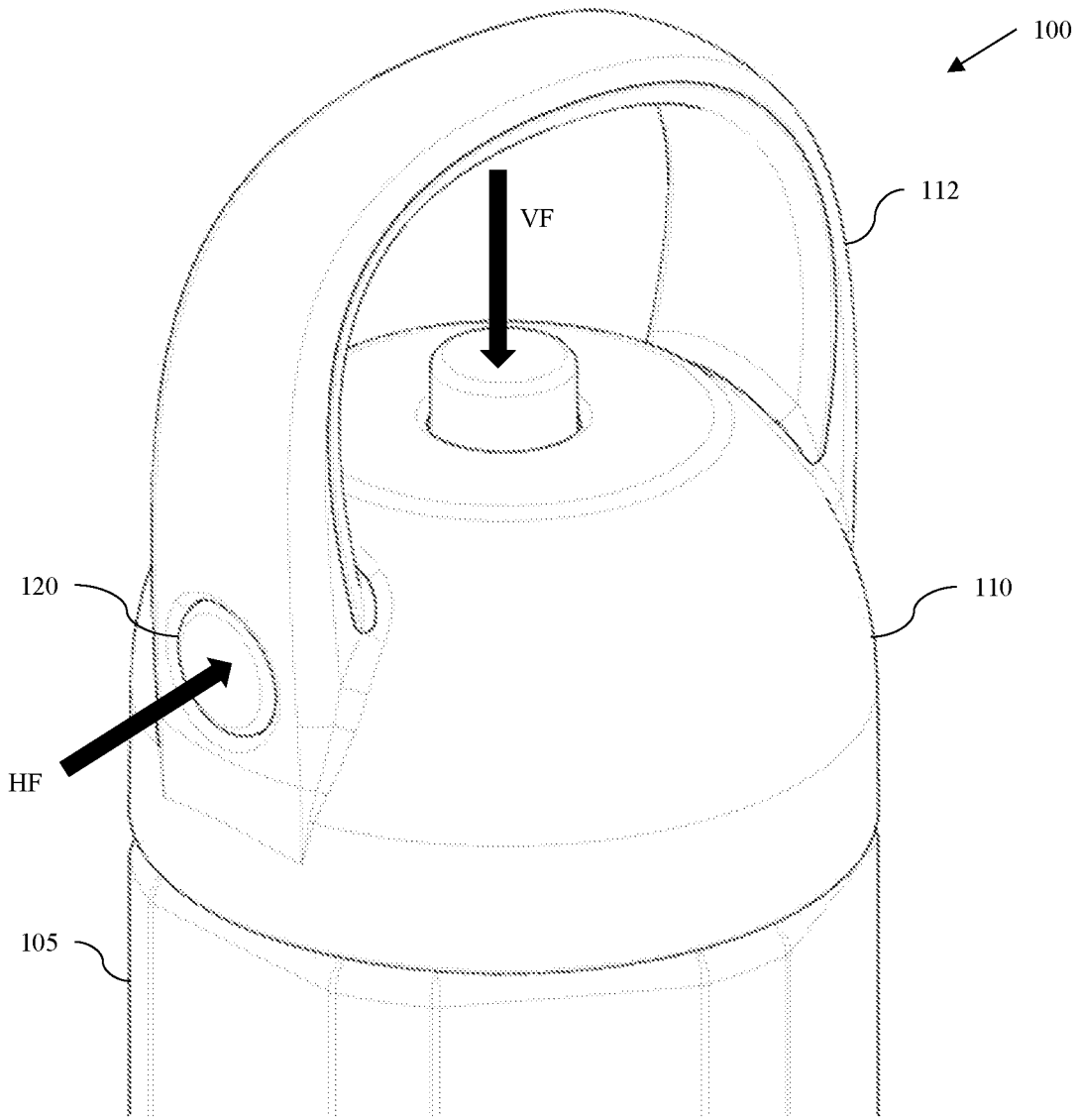
FIG. 1 is a perspective view of a container having a cap in accordance with one embodiment of the invention.

The specific details of the single embodiment or variety of embodiments described herein are set forth in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Figure 2:
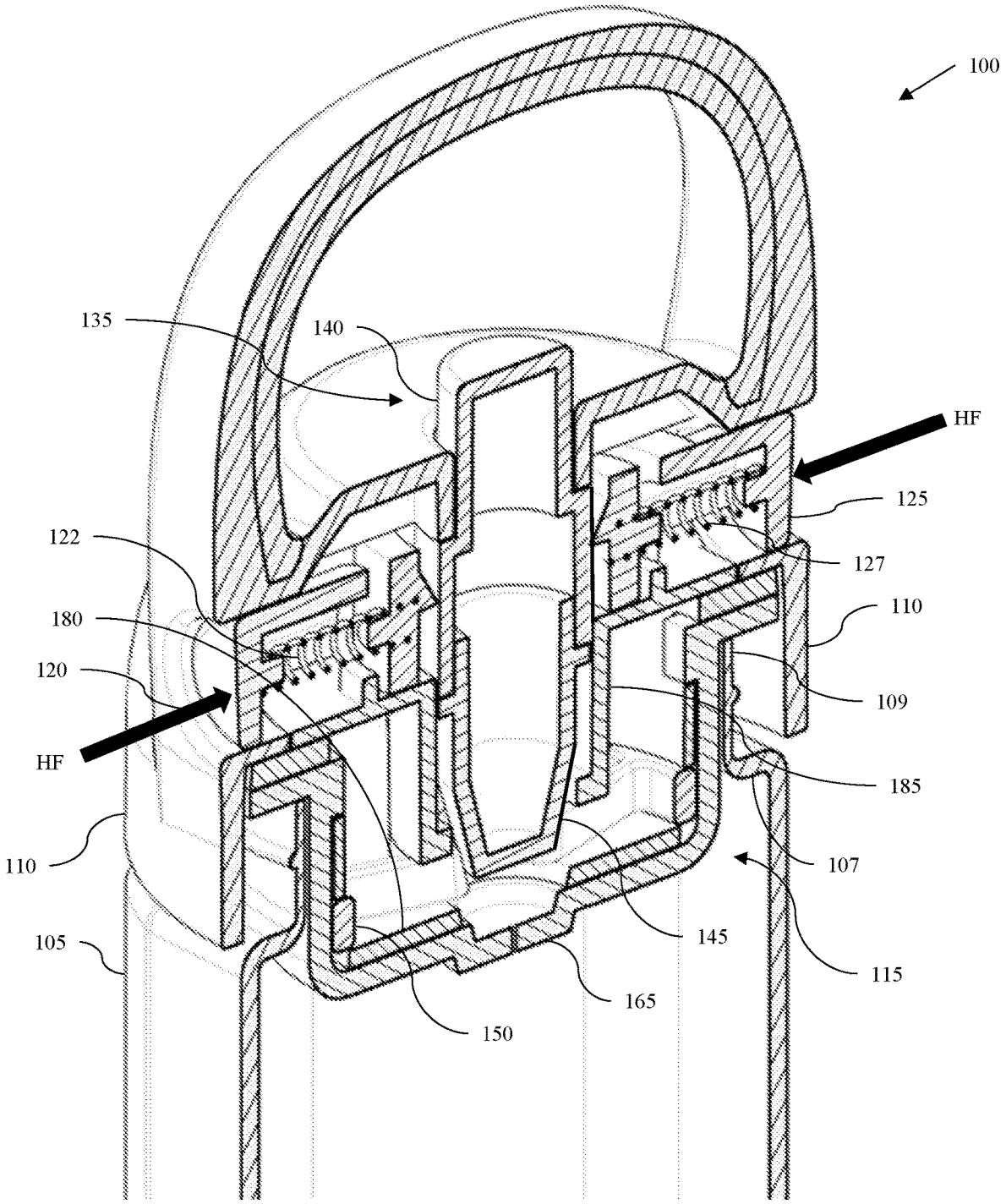
FIG. 2 is a cross-sectional, perspective view of the container of FIG. 1.

Referencing FIG. 1 and FIG. 2, one embodiment of the invention is directed to container 100 having container body 105 and cap 110. Container body 105 can be, for example, a bottle, a cup, a mug, a tumbler, or the like. Cap 110 can be removable from containing body 105. In one embodiment, cap 110 can be removably coupled to container body 105 via sealing assembly 115. In one embodiment, cap 110 can be released from container body 105 by, in part, applying horizontal force HF to opening buttons 120, 125; this releases sealing assembly 115 from container body 105 and then cap 110 can be pulled away from container body 105 by pulling, for example, on cap handle 112. In some embodiments, cap 110 can be locked to container body 105 by, in part, applying vertical force VF to closing button 140, which results in sealing assembly 115 locking to container body 105 as will be described in further detail below.

As illustrated in FIG. 2, in one embodiment sealing assembly 115 can generally include expander actuator 135 operatively coupled to expander 150. Sealing assembly 115 can also include seal 165 operatively coupled to expander 150 and configured to engage container shoulder 107 and container neck 109. In certain embodiments, sealing assembly 115 can include expander holder 180 for receiving and supporting expander 150. In some embodiments, sealing assembly 115 can include expander retainer 185 that is configured to facilitate restraining a vertical movement of expander 150. In one embodiment, expander actuator 135 can include closing button 140 coupled to expander rod 145;

however, in other embodiments, closing button 140 and expander rod 145 can be integrated into a single piece expander actuator 135. In one embodiment, sealing assembly 115 can include opening buttons 120, 125 that are operatively coupled to expander actuator 135 and to opening button springs 122, 127.

Figure 3:
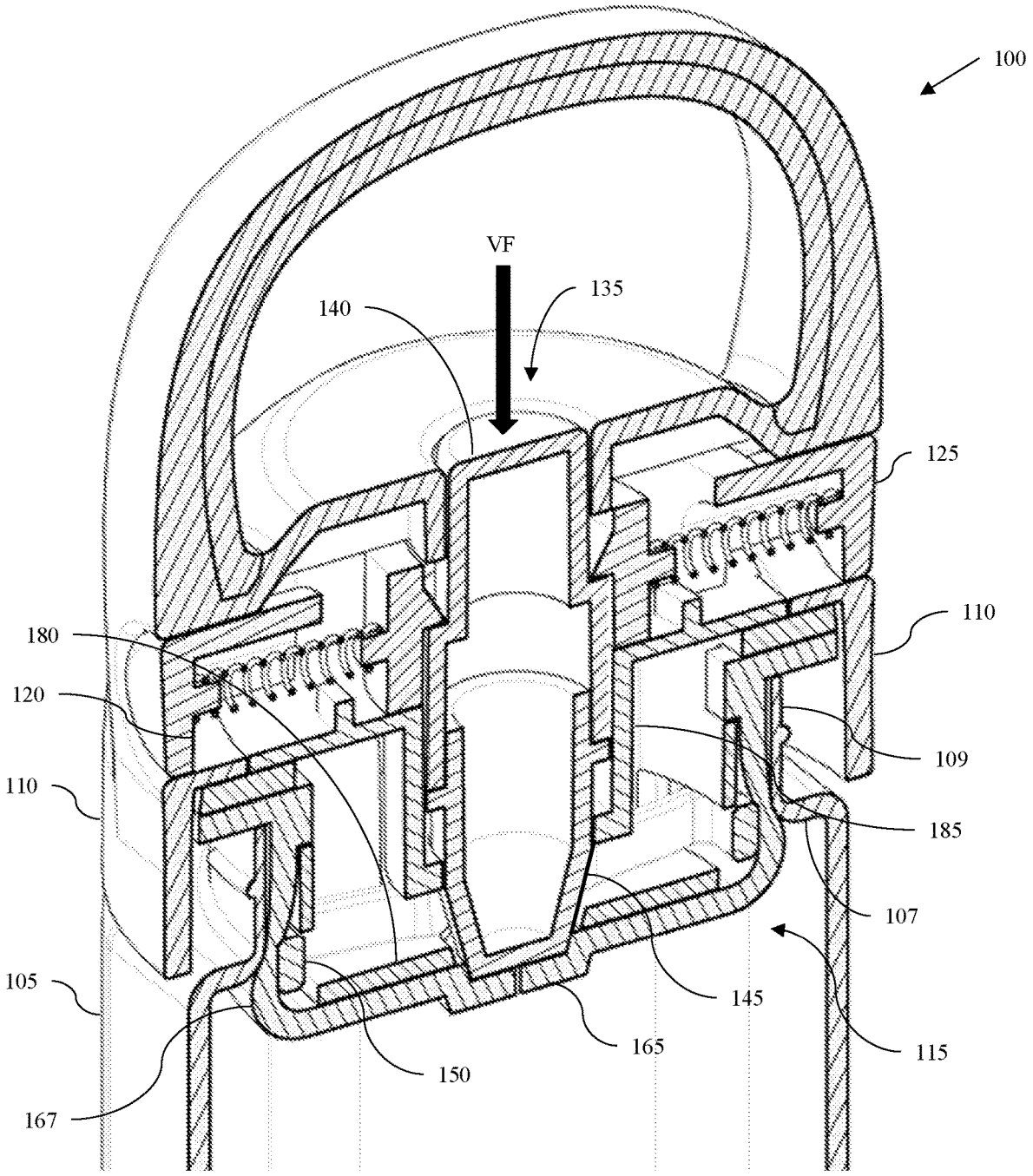
FIG. 3 is another cross-sectional, perspective view of the container of FIG. 1.

Operation of cap 110 and sealing assembly 115 will be described now with reference to FIG. 1 through FIG. 3. As illustrated in FIG. 2, container 100 can be in an unsealed state when actuator 135 is substantially disengaged from expander 150 and from opening buttons 120, 125. Substantially horizontal forces HF are applied to opening buttons 120, 125 to disengage opening buttons 120, 125 from expander actuator 135—in one embodiment, opening buttons 120, 125 are disengaged from closing button 140, which is part (or is operatively coupled to expander rod 145) of expander actuator 135. Opening button spring 122 is compressed between opening button 120 and opening button 125, thereby releasing expander actuator 135 from opening button 125. Opening button spring 127 is compressed between opening button 120 and opening button 125, thereby releasing expander actuator 135 from opening button 127. In this state, opening button 140 protrudes from an orifice of cap 110, and expander rod 145 is substantially disengaged from expander 150. Both expander 150 and seal 165 are in a relaxed, unexpanded form, and therefore, cap 110 along with assembly 115 can be pulled away from container body 105.

To lock cap 110 to container body 115, vertical force VF can be applied to closing button 140 of sealing assembly 115. This causes expander actuator 135 to move vertically against expander 150, which results in engagement of expander rod 145 against expander 150. Expander 150 is configured to expand horizontally against seal 165 upon engagement of expander rod 145 with expander 150. The horizontal expansion of expander 150 causes seal 165 to deform or expand (seal deformation 167, see FIG. 3) against container shoulder 107 and container neck 109. Expander 150 and seal 165 are configured of suitable shape and materials to ensure that the horizontal expansion of expander 150 against seal 165 results in a leak-proof seal of seal 165 against the inside of container body 105. In one embodiment, opening buttons 120, 125 lock closing button 140 in place through engagement of opening button relief 121, 124 (see FIG. 21) with closing button shoulder 142 (see FIG. 22). Opening button springs 122, 127 apply a restoring force, respectively, to opening buttons 120, 125, and thereby opening buttons 120, 125 are again in a position for receiving a horizontal opening force.

Figure 4:
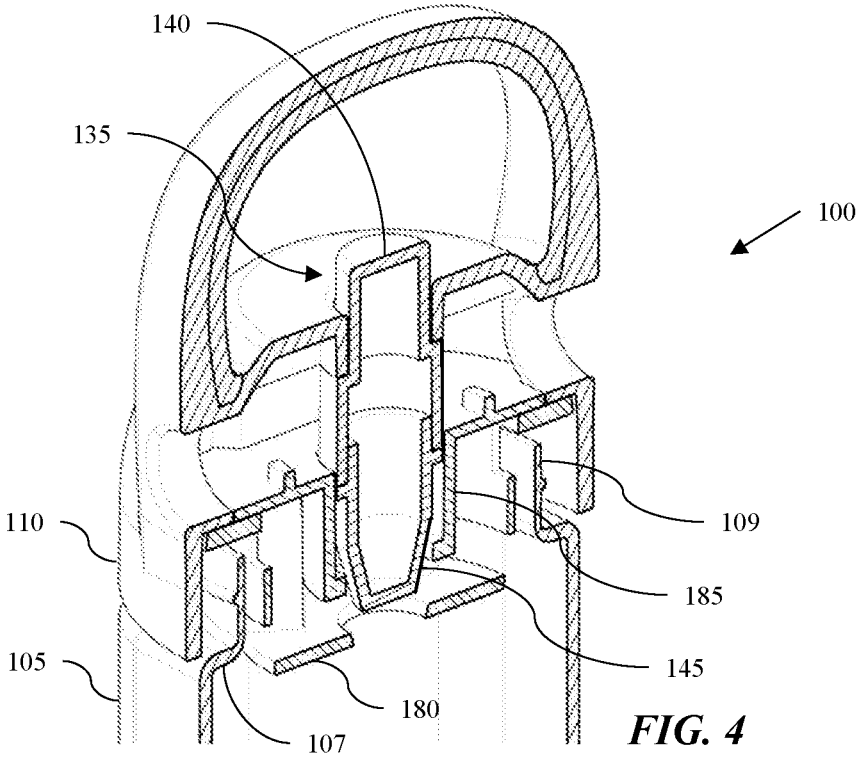
FIG. 4 is a cross-sectional, perspective view of certain components of one embodiment of container of FIG. 1.
Figure 5:
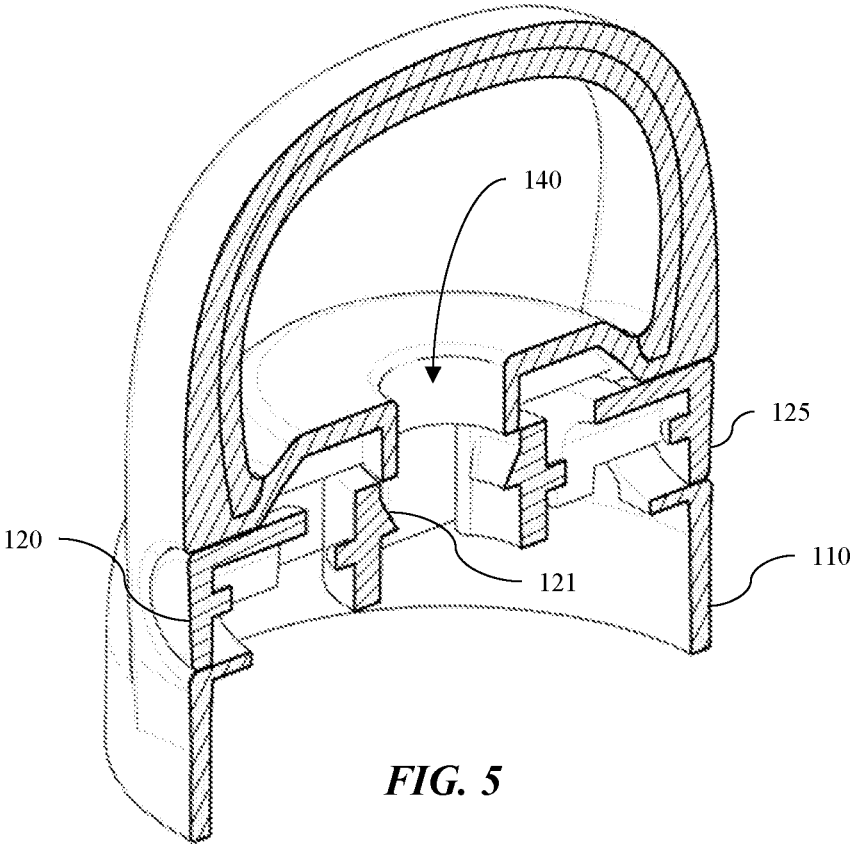
FIG. 5 is a cross-sectional, perspective view of certain components of one embodiment of the container of FIG. 1.

Referencing FIG. 4 and FIG. 5, in one embodiment container 100 can include container body 105 suitably shaped and sized to receive cap 110. In certain embodiments, cap 110 is suitably sized and shaped to receive and house sealing assembly 115. Cap 110 can include cap central orifice 114 configured to receive and house opening buttons 120, 125, closing button 140, expander rod 145, expander holder 180, and/or expander retainer 185.

Figure 6:
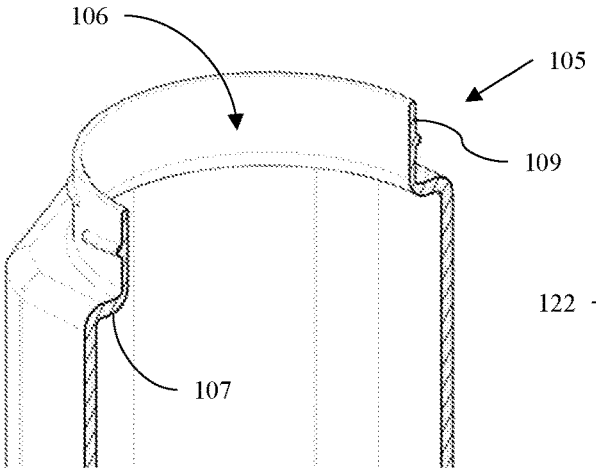
FIG. 6 is a cross-sectional, perspective view of a container suited for use with a cap in accordance with some embodiments of the invention.
Figure 7:
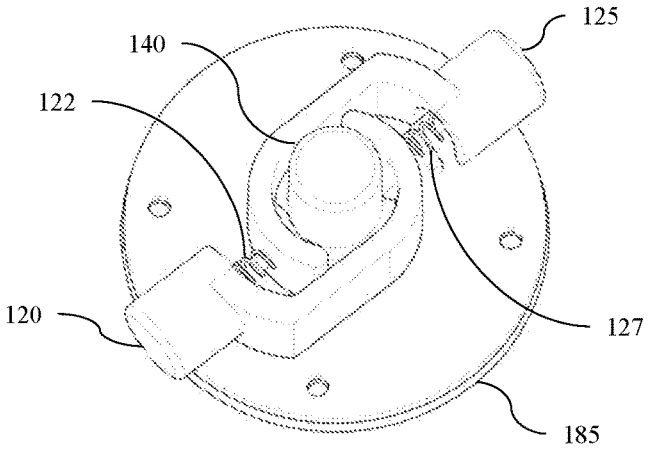
FIG. 7 is a perspective view of certain components that can be used with the container of FIG. 1.

Referencing FIG. 6, in one embodiment container body 105 is preferably configured with container mouth 106, container shoulder 107, and container neck 109 sized and shaped suitably to engage with expander 150 and seal 165. In other embodiments, container body 105 can be configured with a different form at its mouth that facilitates a seal between seal 165 and an inner side of container body 105 when expander 150 expands horizontally. Referencing FIG. 7, it is shown one embodiment of opening buttons 120, 125 and associated button springs 122, 127. Opening buttons 120, 125 are configured for disengaging from closing button 140 upon application of an external force. It is to be understood that in other embodiments only one opening button or more than two opening buttons can be used. In certain embodiments, at least one opening button suitably configured to removably engage and/or disengage closing button 140 can be used.

Figure 8:
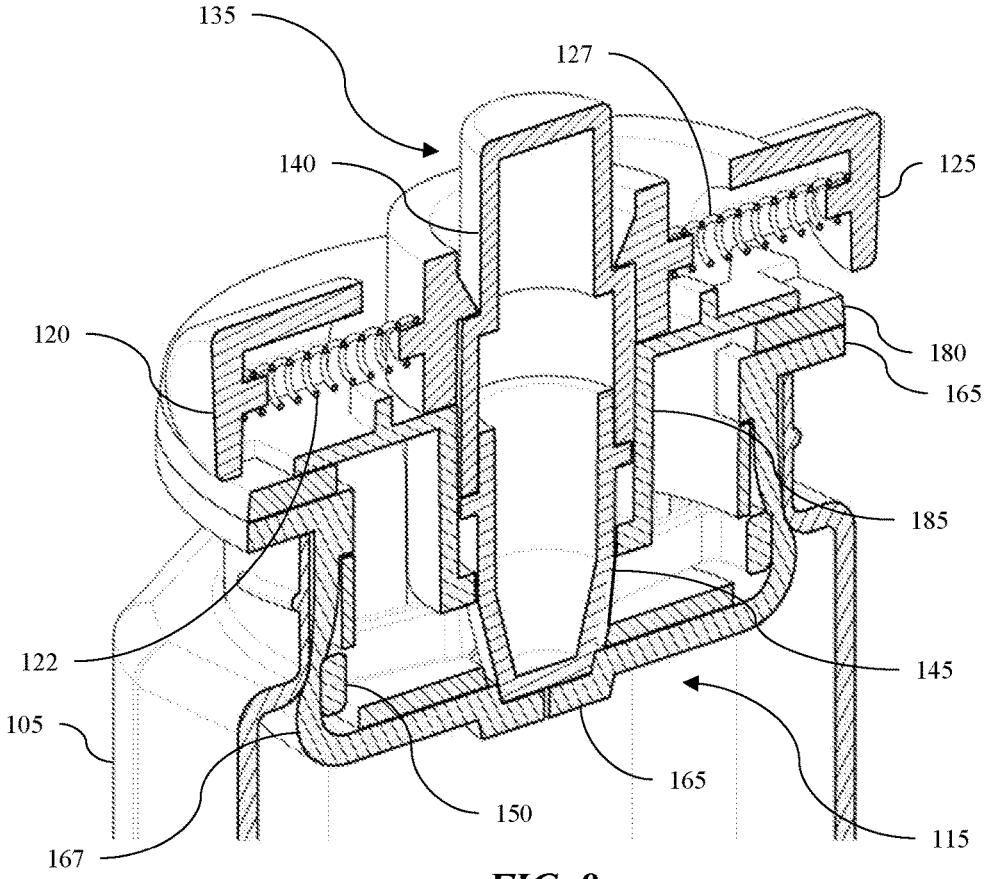
FIG. 8 is a perspective view of certain components that can be used with the container of FIG. 1.
Figure 9:
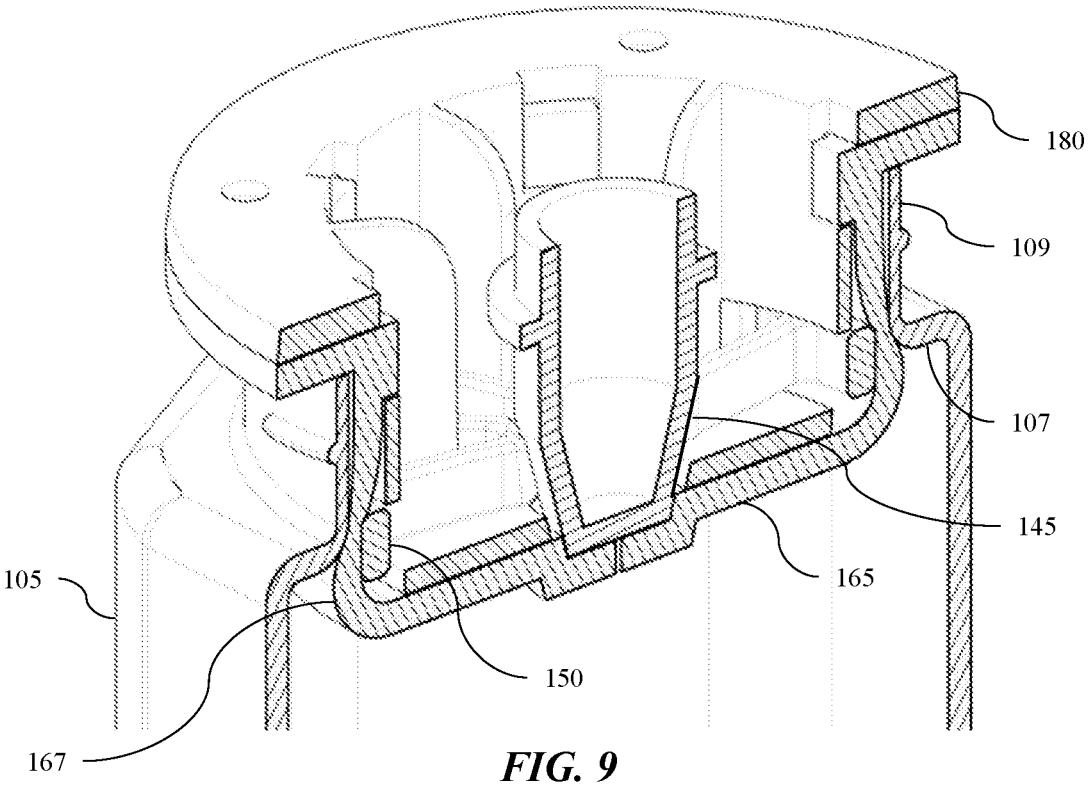
FIG. 9 is a perspective view of certain components that can be used with the container of FIG. 1.
Figure 10:
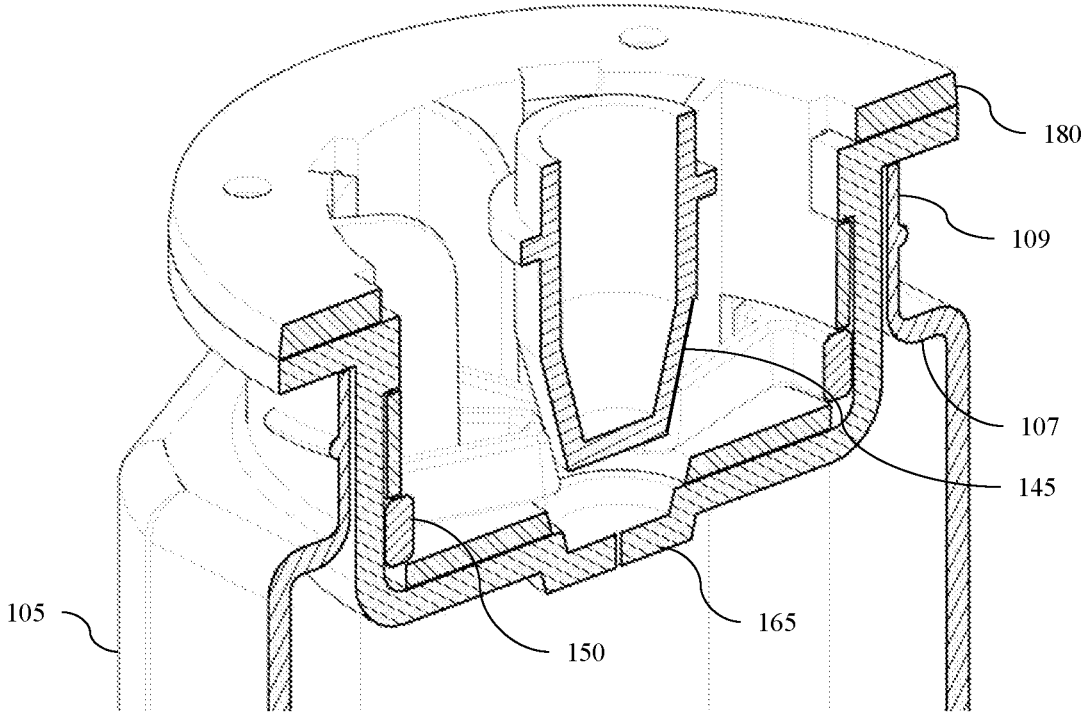
FIG. 10 is a perspective view of certain components that can be used with the container of FIG. 1.

Referencing FIG. 8, in one embodiment seal 165 is suitably configured in size and shape to fit into container neck 109. Seal 165 can be further configured suitably in size and shape to receive and/or support expander holder 180. In one embodiment, expander holder 180 generally nests inside seal 165. In some embodiments, expander retainer 185 is suitably configured to fit into expander holder 180 and to rest on top or above expander 150 to prevent expander 150 from moving or bending in a vertical direction. This facilitate a more precise and reliable seal between seal 165 and container shoulder 107 when expander 150 expands horizontally. Expanding actuator 135 is preferably suitably configured to fit within expander retainer 185. In some embodiments, expanding actuator 135 is configured to operatively couple to expander 150 to cause expander 150 to expand horizontally when an external force is applied to closing button 140. In certain embodiments, expander 150 is suitably configured with a size and shape to fit into and be supported by expander holder 180. Expander 150 can nest insider expander holder 180 and rest upon a surface of expander holder 180.

Referencing FIG. 9 through FIG. 17, in one embodiment seal 165 can be suitably configured to fit into container body 105 and to extend from about container mouth 106, along container neck 109, to beyond container shoulder 107. In some embodiments, expander holder 180 can be configured to substantially nest within seal 165. In a locked state (FIG. 9, FIG. 16) expander rod 145 is configured to push into or through a central part of expander 150 to cause expander 150 to expand horizontally against seal 165. The expansion of expander 150 against seal 165 causes seal deformation 167, which locks up against container shoulder 107. In an unlocked state (FIG. 10, FIG. 17) expander rod 145 is configured to substantially disengage from expander 150. In some embodiments, expander 150 is configured to provide a restoring force to move expander rod 145 vertically upward when expander actuator 135 (including expander rod 145) is released and free to move vertically.

Figure 18:
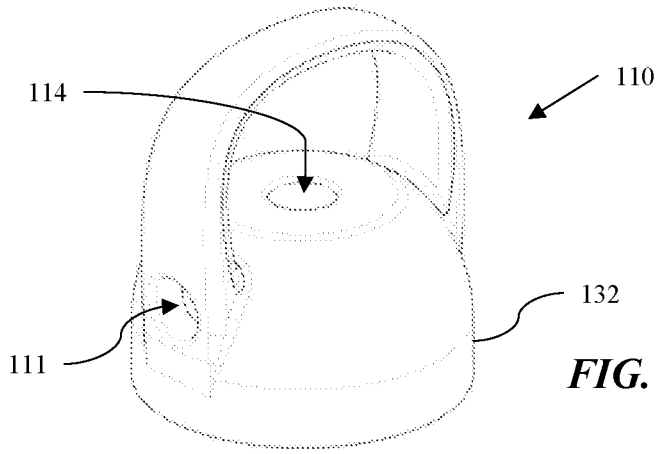
FIG. 18 is a perspective view of a cap cover that can be used with the container of FIG. 1.
Figure 19:
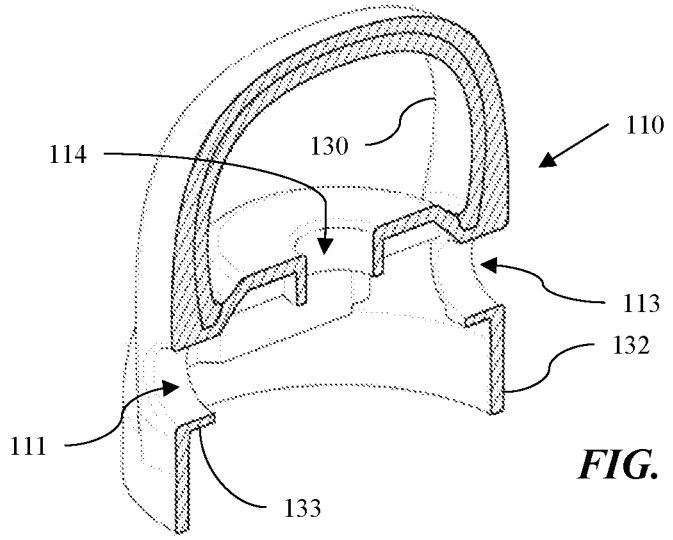
FIG. 19 is cross-sectional, perspective view of the cap cover of FIG. 18.
Figure 20:
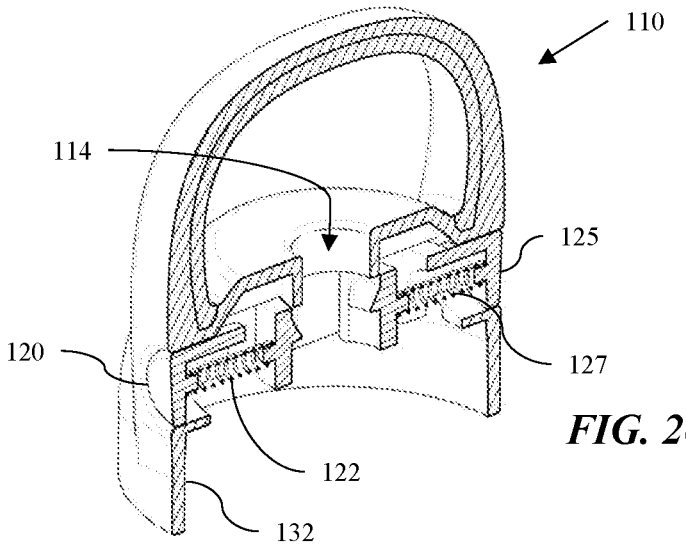
FIG. 20 is cross-sectional, perspective view of certain components that can be used with the container of FIG. 1.

Referencing FIG. 18 through FIG. 20, in one embodiment cap 110 can include cap central orifice 114 configured to receive at least closing button 140, for example. Cap central orifice 114 can be generally centered about a central, vertical axis of container 100. In some embodiments, cap 110 can include cap opening button orifices 111, 113 configured to receive, for example, opening buttons 120, 125. In certain embodiments, cap 110 can include cap handle 112. In one embodiment, cap handle 112 can include cap handle liner 130, which can be configured to provide comfort for a user when, for example, cap 110 is pulled away from container body 105. Cap handle liner 130 can also be configured to facilitate grasping of cap handle 112 through, for example, cap handle liner 130 being made of a suitable material to provide adequate friction. In one embodiment, cap 110 can include cap skirt 132 configured suitably in size and shape to surround and cover container neck 109. In certain embodiments, cap skirt 132 can include cap skirt shoulder 133 configured to rest upon (or abut against) expander retainer 185 when cap 110 and sealing assembly 115 are assembled for use with container body 105.

Figure 21:
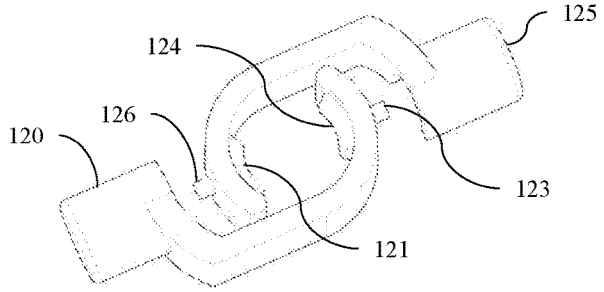
FIG. 21 is a perspective view of opening buttons that can be used with the container of FIG. 1.

Referencing FIG. 21, in one embodiment sealing assembly 115 can include opening buttons 120, 125 configured to operatively couple and facilitate both locking to and disengaging from expander actuator 150 (or closing button 140). In certain embodiments, opening buttons 120, 125 can include respectively opening button relief 121, 124 configured to engage closing button shoulder 142 and keep closing button locked in place—until opening button relief 121, 124 is disengaged from closing button shoulder 142 upon application of an external force to opening buttons 120, 125. In the embodiment shown, being able to pull cap 110 (and, therefore sealing assembly 115) away from container body 105 requires that both opening buttons 120, 125 be activated at the same time by an external force. In one embodiment, opening buttons 120, 125 are respectively configured with spring locating pins 123, 126 respectively.

Figure 22:
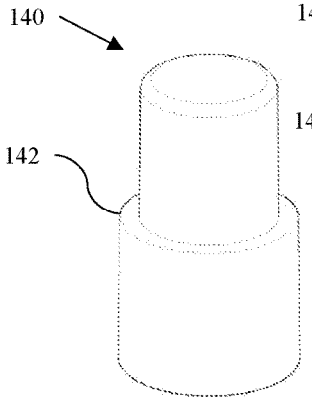
FIG. 22 is a perspective view of a closing button that can be used with the container of FIG. 1.
Figure 23:
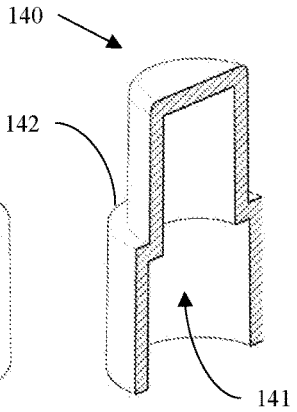
FIG. 23 is cross-sectional, perspective view of the closing button of FIG. 22.

Referencing FIG. 22 and FIG. 23, in one embodiment closing button 140 can include closing button shoulder 142 configured to operatively couple for engagement and disengagement with opening button reliefs 121, 124. In some embodiments, closing button 140 can include closing button cavity 141 configured to receive and/or retain expander rod 145, which expander rod 145 can be retained in closing button 140 by, for example, a press fit.

Figure 24:
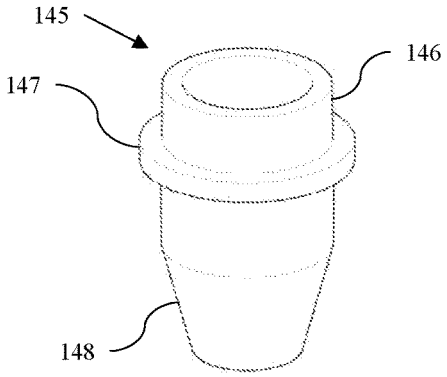
FIG. 24 is a perspective view of an expander rod that can be used with the container of FIG. 1.
Figure 25:
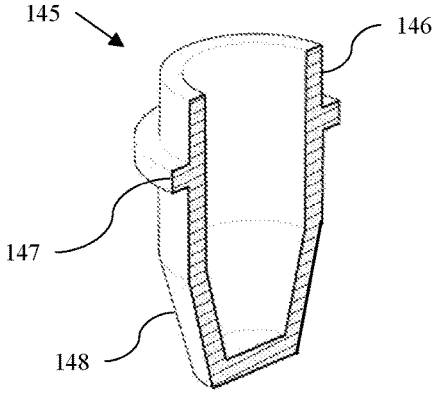
FIG. 25 is cross-sectional, perspective view of the expander rod of FIG. 24.

Referencing FIG. 24 and FIG. 25, in some embodiments expander rod 145 can include closing button interface 146 which is an upper part of expander rod 145, wherein closing button interface 146 is configured to couple to closing button 140. In one embodiment, expander rod 145 can include expander rod shoulder 147 configured to, among other things, facilitate a stop motion in cooperation with expander retainer footer 187. In certain embodiments, expander rod 145 can include expander actuator cone 148 configured to operatively couple to expander 150 to cause expander 150 to expand horizontally when expander actuator cone 148 acts upon expander 150. In one embodiment expander actuator cone 148 has a frusto-conical shape configured to be inserted into a central opening of expander 150 and to engage expander radial arms 160. In other embodiments, expander actuator cone 148 can have a similar or different shape to produce a horizontal expansion of expander 150. In certain embodiments, closing button 140 and expander rod 150 can be configured to be a single piece (forming expander actuator 135).

Figure 26:
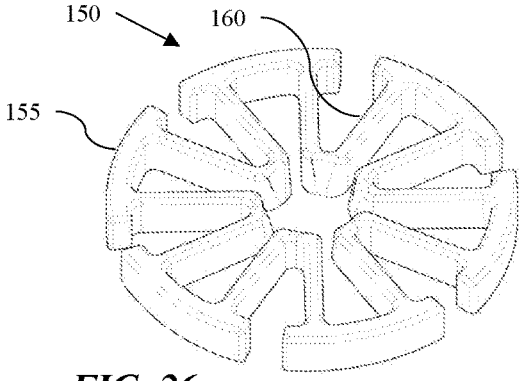
FIG. 26 is a perspective view of an expander that can be used with the container of FIG. 1.
Figure 27:
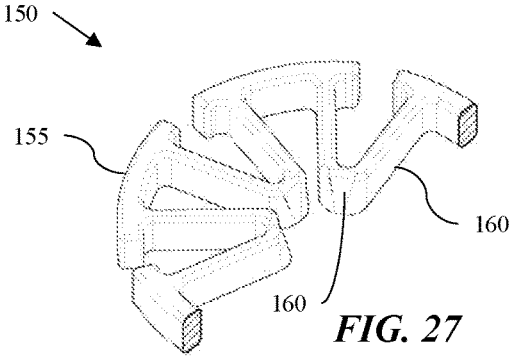
FIG. 27 is cross-sectional, perspective view of the expander of FIG. 26.

Referencing FIG. 26 and FIG. 27, in one embodiment expander 150 can include multiple expander radial arms 160 connected to expander wall 155. Preferably expander radial arms 160 are configured to be semi-rigid and to have resilience to produce a radial expansion of expander 150 in a horizontal plane when acted upon by, for example, expander cone actuator 148. In some embodiments, expander radial arms 160 can include actuator interfaces 162 configured to operatively couple to expander cone actuator 148. Actuator interfaces 162 can include a tapered surface configured to facilitate a penetration of expander 150 by expander actuator cone 148 when closing button 140 is acted upon by a vertical external force, and to facilitate an upward, vertical push of actuator cone 148 by expander 150 when opening buttons 120, 125 disengage from closing button 140 to unlock sealing assembly 115 from container body 105.

Figure 28:
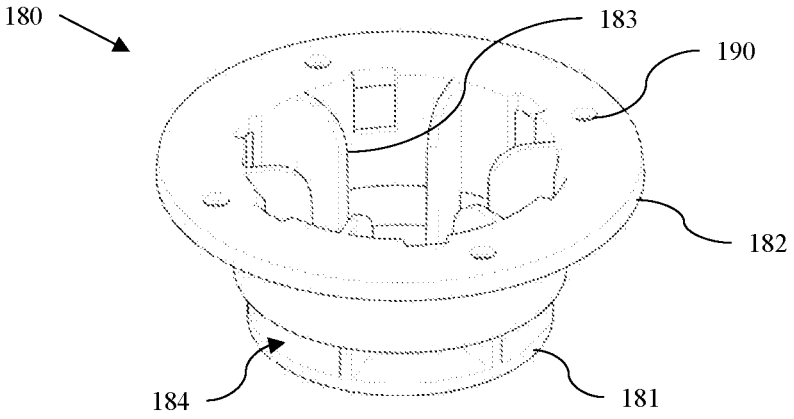
FIG. 28 is a perspective view of an expander holder that can be used with the container of FIG. 1.
Figure 29:
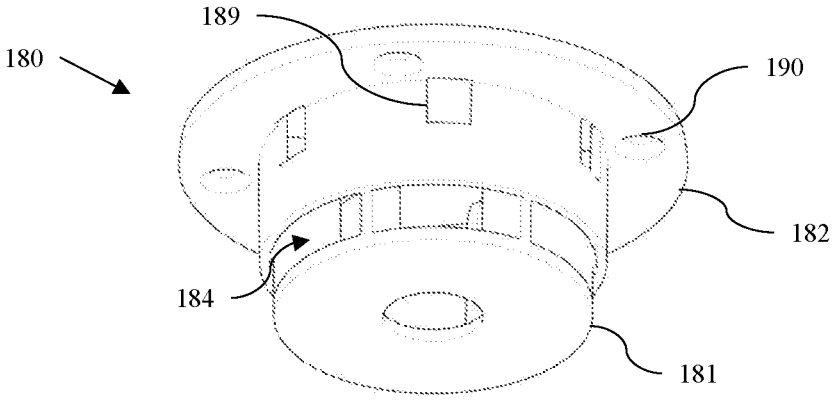
FIG. 29 is another perspective view of the expander holder of FIG. 28.
Figure 30:
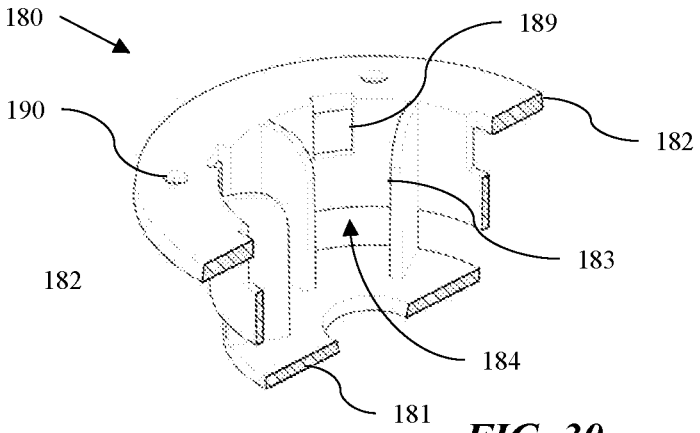
FIG. 30 is cross-sectional, perspective view of the expander holder of FIG. 28.

Referencing FIG. 28 through FIG. 30, in one embodiment expander holder 180 can include expander holder base 181 configured to receive and support expander 150. In some embodiments, expander holder 180 can include expander holder flange 182 configured to, among other things, interface with seal 165 and expander retainer 185. In certain embodiments, expander holder 180 can include expander holder ribs 183 configured to, among other things, provide rigidity to expander holder 180, locate expander 150, and/or constrain a rotational movement of expander 150. In one embodiment, expander holder 180 can include multiple expander holder openings 184 configured to allow a horizontal expansion of expander 150 in expander holder 180. In some embodiments, expander holder 180 can include multiple expander holder seal windows 189 configured to facilitate locating expander holder 180 in seal 165. In certain embodiments, expander holder 180 can include multiple expander holder flange through holes 190 configured to facilitate the passing of fasteners to secure cap 110 to other components of sealing assembly 115.

Figure 11:
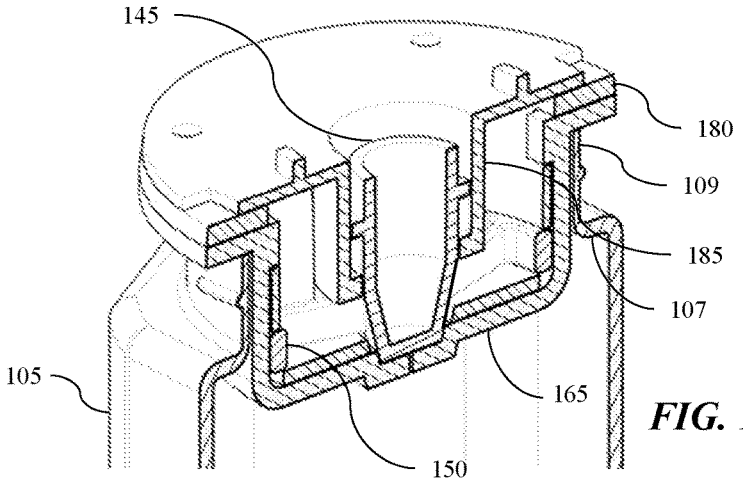
FIG. 11 is a perspective view of certain components that can be used with the container of FIG. 1.
Figure 12:
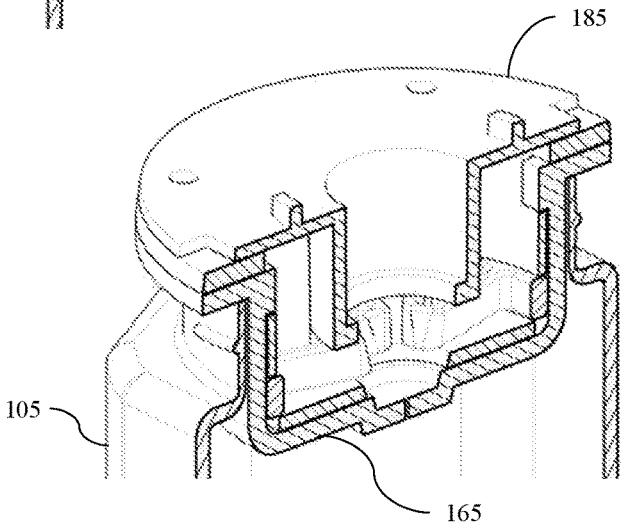
FIG. 12 is a perspective view of certain components that can be used with the container of FIG. 1.
Figure 13:
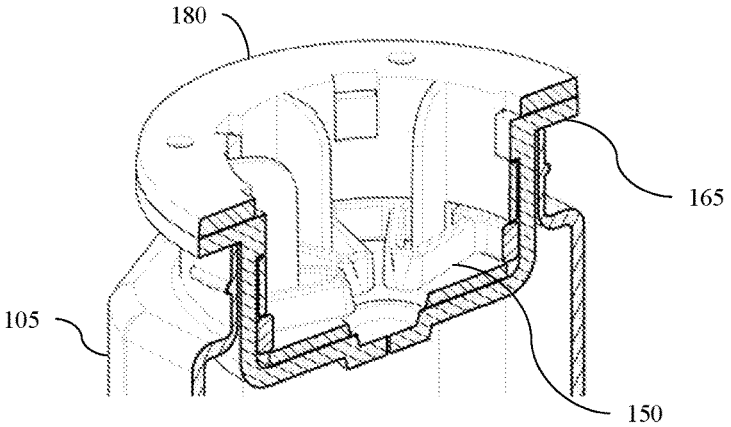
FIG. 13 is a perspective view of certain components that can be used with the container of FIG. 1.
Figure 14:
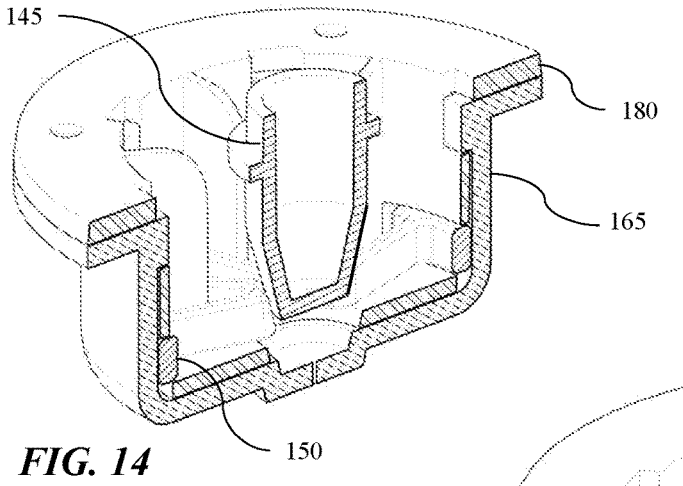
FIG. 14 is a perspective view of certain components that can be used with the container of FIG. 1.
Figure 15:
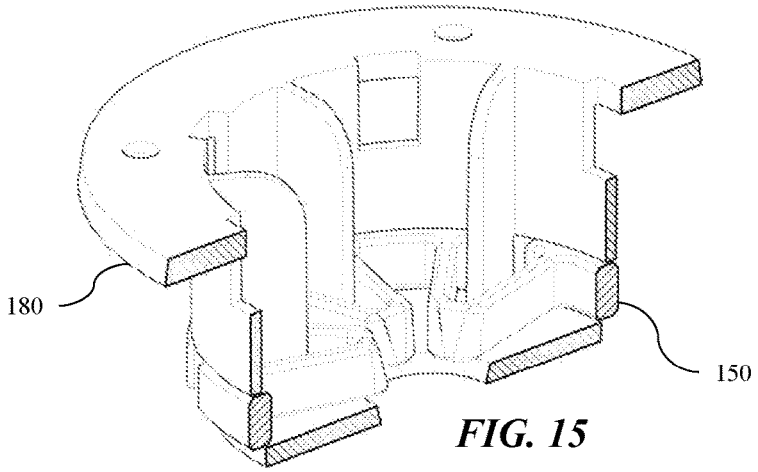
FIG. 15 is a perspective view of certain components that can be used with the container of FIG. 1.
Figure 16:
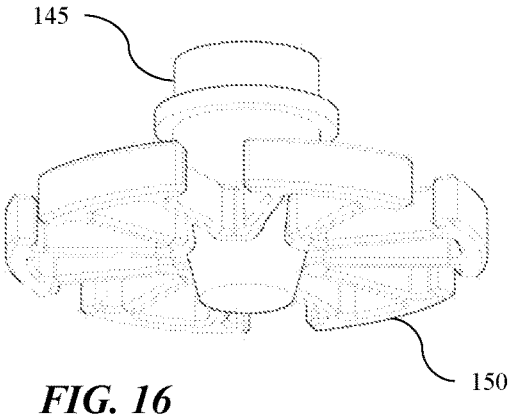
FIG. 16 is a perspective view of certain components, in a first configuration, that can be used with the container of FIG. 1.
Figure 17:
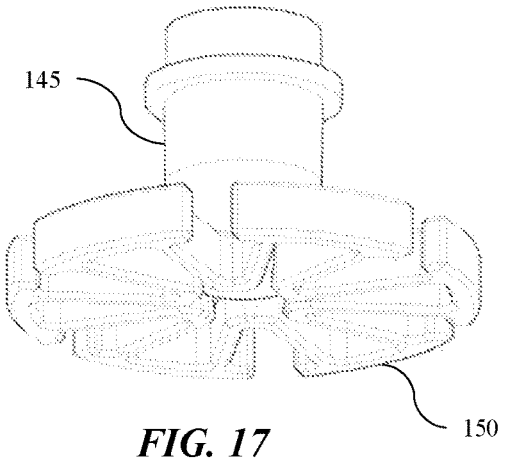
FIG. 17 is a perspective view the components of FIG. 16 in a second configuration.
Figure 31:
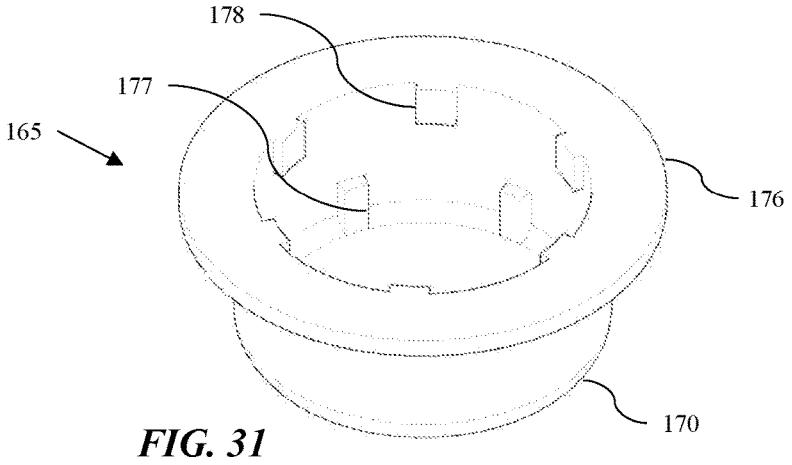
FIG. 31 is a perspective view of a seal that can be used with the container of FIG. 1.
Figure 32:
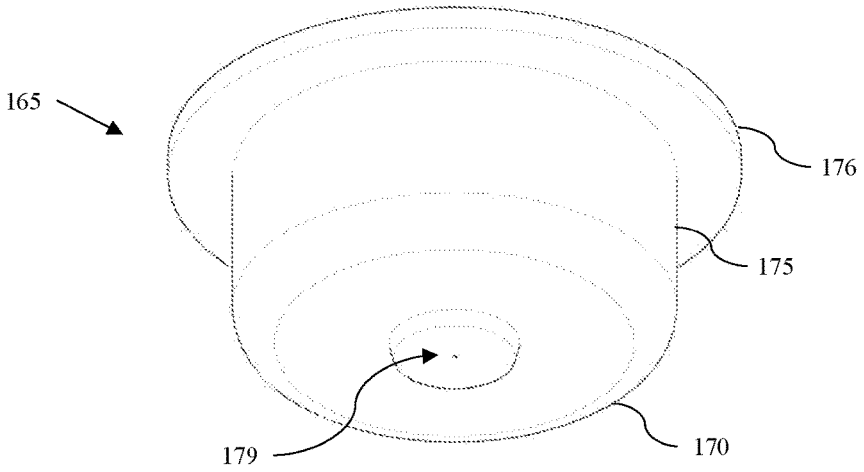
FIG. 32 is another perspective view of the seal of FIG. 31.
Figure 33:
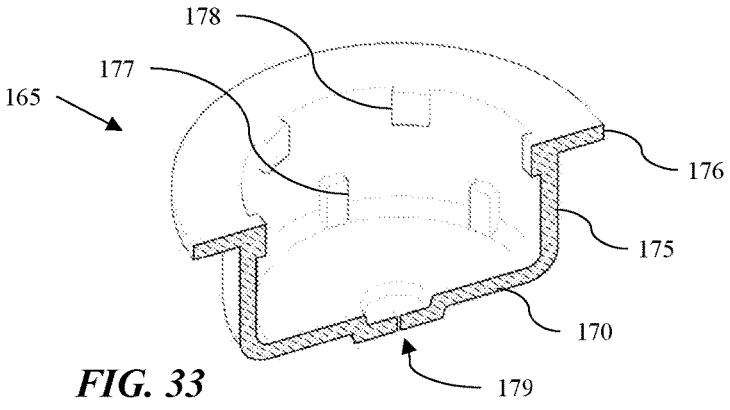
FIG. 33 is cross-sectional, perspective view of the seal of FIG. 31.

Referencing FIG. 31 through FIG. 33, in one embodiment seal 165 can include seal base 170, seal wall 175, and seal flange 176. Seal base 170 and seal wall 175 are configured to suitably expand upon an expansion of expander 150 against seal wall 175. In some embodiments, seal 165 can include seal expander protrusions 177 configured to, among other things, prevent rotation of expander 150 in a horizontal plane. In certain embodiments, seal expander 165 can include seal expander holder protrusions 178 configured to, among other things, couple with expander holder windows 189 to facilitate location of expander holder 180 in seal 165 and to increase retention of seal 165 in expander holder 180. Seal flange 176 can be configured with suitable size and shape to fit over container neck 109 (FIG. 11, for example). In one embodiment, seal 165 can include seal orifice 179 for facilitating the equalization of pressure between the outside and inside of container 100.

Figure 34:
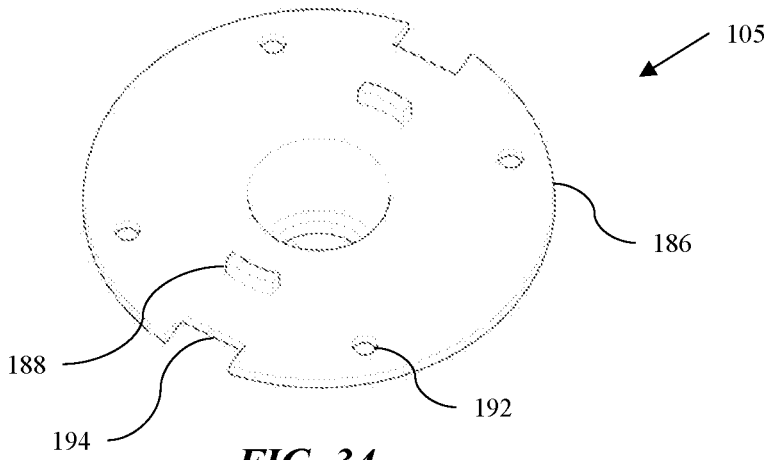
FIG. 34 is a perspective view of an expander retainer that can be used with the container of FIG. 1.
Figure 35:
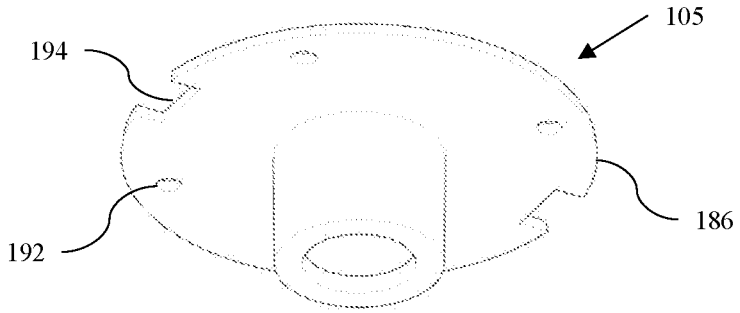
FIG. 35 is another perspective view of the expander retainer of FIG. 34.
Figure 36:
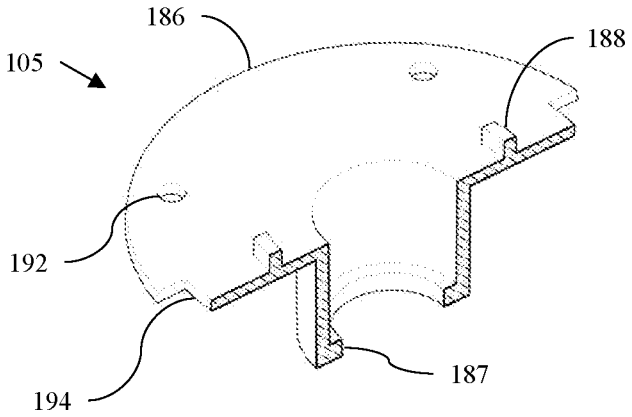
FIG. 36 is cross-sectional, perspective view of the expander retainer of FIG. 34.

Referencing FIG. 34 through FIG. 36, in one embodiment expander retainer 185 can include expander retainer plate 186 configured to, among other things, provide an interface surface that facilitates support of expander retainer 185 by expander holder 180 when sealing assembly 115 is assembled. In some embodiments, expander retainer 185 can include expander retainer footer 187 configured to, among other things, facilitate constraining a vertical movement or bending of expander 150 when sealing assembly 115 is assembled. In certain embodiments, expander retainer footer 187 can be configured to provide a motion stop for expander rod 145 by engaging with expander rod shoulder 147 and limiting the downward motion of expander rod 145 when closing button 140 is acted upon by a downward, external force. In one embodiment, expander retainer plate 186 can include expander retainer protrusions 188 configured to provide stops of horizontal movement of opening buttons 120, 125; expander retainer protrusions 188 facilitate, among other things, the movement of opening button 120 to be independent of a movement of button 125, and vice versa. In some embodiments, expander retainer plate 186 can include expander retainer orifices 192 configured to facilitate the passing of fasteners to secure cap 110 to other components of sealing assembly 115. In certain embodiments, expander retainer plate 186 can include expander retainer notches 194 configured to, among other things, facilitate receiving cap skirt shoulder 133 (FIG. 19) to provide locating and retaining expander retainer 185 generally within cap 110 and sealing assembly 115.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible in light of the above teachings without departing from the following claims.

The invention claimed is:

1. A cap comprising:

a seal;

an expander configured to expand horizontally against the seal;

an expander actuator configured to operatively couple to the expander;

at least one opening button configured to operatively couple to an expander rod;

wherein the at least one opening button is configured to disengage from the expander actuator upon the application of a first external force to the at least one opening button; and wherein the expander rod is configured to produce an horizontal expansion of the expander upon the application of a second external force to the expander actuator.

2. The cap of claim 1, further comprising an expander holder configured to receive and support the expander.

3. The cap of claim 2, further comprising an expander retainer configured to facilitate constraining a movement of the expander in a vertical direction.

4. The cap of claim 1, wherein the expander actuator comprises a closing button operatively coupled to an expander rod.

5. The cap of claim 1, wherein the seal comprises a seal base and an annular vertical seal wall, and wherein the seal base and at least part of the seal wall are configured to expand horizontally upon an horizontal expansion of the expander against the seal wall.

6. The cap of claim 1, wherein the expander comprises an annular expander wall that is operatively coupled to the expander actuator, wherein the expander wall is configured to expand horizontally against the seal upon an engagement of the expander actuator with the expander, and wherein the expander wall is configured to return to an unexpanded form upon a disengagement of the expander actuator from the expander.

7. The cap of claim 6, wherein the expander further comprises expander radial arms configured to engage with the expander actuator, wherein the expander radial arms are configured to move horizontally towards the seal wall upon an engagement of the expander actuator with the expander, and wherein the expander arms are configured to move horizontally away from the seal wall upon a disengagement of the expander actuator from the expander.

8. A cap comprising:

a plurality of opening buttons configured to move towards a central axis of a container upon the application of a first force to the plurality of opening buttons;

an expander actuator configured to operatively couple to the plurality of opening buttons, wherein the expander actuator and the plurality of opening buttons are configured to produce a disengagement of the opening buttons from the expander actuator upon the application of the first force to the plurality of opening buttons;

an expander configured to operatively couple to the expander actuator, wherein the expander is configured to expand horizontally upon an application of a second force to the expander actuator; and a seal configured to operatively couple to the expander, wherein the seal is configured to expand against a wall of the container upon an horizontal expansion of the expander against the seal.

9. The cap of claim 8, wherein the plurality of opening buttons is configured to move horizontally relative to a central axis of the container upon application of the first force to the plurality of opening buttons.

10. The cap of claim 8, wherein the expander actuator is configured to move parallel to a central axis of the container upon the application of the second force to the expander actuator.

11. The cap of claim 9, wherein the expander actuator is configured to move parallel to a central axis of the container upon the application of the second force to the expander actuator.

12. The cap of claim 8, wherein the expander actuator comprises a closing button operatively coupled to an expander rod.

13. The cap of claim 12, wherein the expander rod is configured to transfer the second force to the expander.

14. The cap of claim 8, further comprising an expander holder configured to receive and support the expander.

15. The cap of claim 14, further comprising an expander retainer configured to constrain a vertical movement, along the central axis of the container, of the expander.

16. A sealing assembly comprising:

an expander actuator configured to move vertically along a main axis of a container;

an expander configured to operatively couple to the expander actuator, wherein the expander is configured to expand horizontally upon an application of a first force to the expander actuator; and a seal configured to operatively couple to the expander, wherein the seal is configured to expand against a wall of the container upon an horizontal expansion of the expander against the seal.

17. The sealing assembly of claim 16, further comprising at least one opening button configured to operatively couple to the expander actuator, wherein the expander actuator and the at least one opening button are configured to produce a disengagement of the at least one opening button from the expander actuator upon the application of a second force to the at least one opening button.

18. The sealing assembly of claim 16, further comprising an expander holder configured to receive and support the expander.

19. The sealing assembly of claim 18, further comprising an expander retainer configured to constrain a vertical movement of the expander.

20. The sealing assembly of claim 17, wherein the expander is configured to cause a vertical upward movement of the expander actuator upon the disengagement of the at least one opening button from the expander actuator.

* * * * *